US009975724B2

(12) United States Patent
Lam

(10) Patent No.: US 9,975,724 B2
(45) Date of Patent: May 22, 2018

(54) TAPE APPLICATOR

(75) Inventor: Joe Augustine S. T. Lam, Vancouver (CA)

(73) Assignee: LAMUS ENTERPRISES INC., Vancouver, British Columbia (CA)

( * ) Notice: Subject to any disclaimer, the term of this patent is extended or adjusted under 35 U.S.C. 154(b) by 741 days.

(21) Appl. No.: 13/137,550

(22) Filed: Aug. 25, 2011

(65) Prior Publication Data

US 2013/0048218 A1 Feb. 28, 2013

(51) Int. Cl.
*B65H 35/00* (2006.01)

(52) U.S. Cl.
CPC ..... *B65H 35/0013* (2013.01); *B65H 2801/81* (2013.01); *Y10T 156/12* (2015.01); *Y10T 156/17* (2015.01)

(58) Field of Classification Search
CPC ..... B65B 51/00; B65B 51/06; B65B 51/067; B65H 35/0006; B65H 35/0013; B65H 35/04; B65H 35/06; B32B 38/04; B32B 37/10; B32B 37/12; B32B 38/10; B32B 38/18
USPC ..... 156/475, 477.1, 478–480, 486–489, 493, 156/510, 516, 517
See application file for complete search history.

(56) References Cited

U.S. PATENT DOCUMENTS

| | | | | | |
|---|---|---|---|---|---|
| 3,108,033 | A | * | 10/1963 | Carter | 156/492 |
| 4,039,367 | A | * | 8/1977 | Warshaw et al. | 156/486 |
| 4,592,188 | A | * | 6/1986 | Marchetti | 53/136.4 |
| 4,642,157 | A | | 2/1987 | Cavanagh | |
| 4,738,075 | A | | 4/1988 | Marchetti | |
| 4,813,206 | A | * | 3/1989 | DiRusso et al. | 53/136.4 |
| 4,889,581 | A | | 12/1989 | Ulrich et al. | |
| 5,223,075 | A | | 6/1993 | Sims | |
| 5,439,549 | A | * | 8/1995 | Fryc et al. | 156/461 |
| 5,725,721 | A | | 3/1998 | Yeh | |
| 6,553,884 | B1 | | 4/2003 | Luhmann et al. | |
| 6,799,623 | B1 | * | 10/2004 | Cheng | 156/527 |
| 7,836,932 | B2 | | 11/2010 | Lucht | |
| 2002/0005258 | A1 | | 1/2002 | Tsunken et al. | |
| 2008/0264571 | A1 | | 10/2008 | Lam | |
| 2012/0111472 | A1 | | 5/2012 | Vega et al. | |

* cited by examiner

*Primary Examiner* — Mark A Osele
*Assistant Examiner* — Christopher C Caillouet

(57) ABSTRACT

An improved tape applicator for apply a tape to close a case or box is provided that uses a wiper system that better seals the tape to the box, provides an improved cut-off system wherein the action of the cut-off blade which partially cuts and then tears the tape is across the tape path at an improved angle. Also included is an improved system for adjusting tab length on the lead end of the case, providing a stiffened free end portion of the tape to engage an on-coming case, for controlling the rotation of large tape rolls by applying pressure to the side of a large roll and locking the tape roll to the mounting hub on the machine by penetrating the tape roll core with locking elements.

15 Claims, 7 Drawing Sheets

TAPE APPLICATOR

FIELD OF INVENTION

The present invention relates to a tape applicator for applying closure tapes to close cartons and incorporating improvements help to overcome or significantly reduce taping problems that have plagued the industry for years problems such as insufficient tape adhesion on under-filled boxes or cartons, tape cutting safety risk and deficiency and tape feeding issues.

BACKGROUND OF THE PRESENT INVENTION

Equipment for applying tape in a C-clip configuration are very well known and are commonplace in the literature and the industry A conventional taping machine uses a conveying system to advance the carton through the tape applicators positioned to apply a strip of tape from a roll of tape to the carton from the top, the bottom or the side with different speeds under different carton packaged conditions such as empty, over-filled or under-filled cartons. Such applicators generally apply a continuous ribbon of tape onto a leading face of a case or carton passing through the machine, along the surface of the case facing the taper and at least partway along the trailing face of the case i.e. the ribbon of tape forms a C-shape. The tape is applied against the leading face using a front applicator which holds the tape to top (assuming a tape application to the top of a case or carton) and then applied against the trailing face of the case using a rear tape applicator. The applicators are usually in the form roll but sometimes the roll is replaced with a wiper.

Common problems in carton taping include loosely wrinkled tape left on the taped carton; flagging at the rear corner; tape not making sufficient surface contact to adhere to the carton particularly in soft, under-packed or un-even surfaces carton conditions. Conventional tape applicators generally rely on the front application or wipe down roller to apply pressure on the tape to the top of the carton and a brush located at the discharge end of the tape applicator for tape wiping action. (See for example U.S. Pat. Nos. 4,738,075; 4,889,581; 5,223,075 and/or 7,836,932). The rear applicator or roller is linked to the front roller by a push bar and a spring biases these rolls toward the case being taped, the rear roller pressure is affected by the spring tension and drag from the up-stream tape path including force required to pull the tape from the tape supply roll and the preset tension required for tape cutting and, friction generated by the rollers. When the resisting tape tension increased or a light spring force setting is being used for soft carton, the tape will pull the front and the rear rollers away from the surface of the carton, reducing the application pressure or completely losing surface contact between the tape and the carton, with insufficient tape adhesion to the carton during the application process, the tape cut off with a sudden release of tension causing the tape to snap back with wrinkled, misaligned or crumpled tape placement on the carton which is being brush down by a brush further down the end of the tape applicator. In most common situations the trailing cut-off end of the tape snap backs and the adjacent adhesive surfaces stick together (referred to in the art as flagging, crumpling) around the rear corner of the carton, surface of the causing a defective sealing closure between the flaps and the vertical carton.

US publication no 2008-0264571 dated Oct. 30, 2008 applicant Lam discloses a wiper element mounted on the front applicator arm and functioning as a front applicator for providing access to a cutter positioned behind it to cut a leading end of a newly threaded tape and to wipe the tape as it is being applied onto the carton or case being sealed by the tape. This wiper mounted on the front applicator arm aggravated the above-mentioned problem because the tape generated more friction around the end of the wiper that in many cases dragged the wiper away from the taping surface.

In conventional taping devices at the point of cutting, the contact with the tape and the tip of the blade is almost at a right angle. When a serrated blade is used the teeth of the serrated blade penetrate through the thickness of the tape, resulting in the tip of the teeth puncturing the tape at contact and wedging the tape to the bottom of the teeth, as a result, any adhesive or loose debris of tape from the cutting may wedged in between the bottom of the teeth, consolidated and slowly build up. As a result it is common practice to provide an oil pad attached to the blade cover to lubricate the cutting blade to minimize the amount of build-up, however, it still requires periodically cleaning. Otherwise it will affect the tape cutting causing production down-time. U.S. Pat. No. 6,553,884 illustrates an attempt to overcome this problem. Another problem with conventional tape applicators is related to holding and guiding the end of the tape in position for application to the leading end of a case or carton being taped. Since the leading portion of the tape has to be apply onto the vertical surface of the carton, the front application roller and the leading end of the tape has to protrude into a position to face the incoming carton to allow the adhesive surface of leading end of the tape to make contact with the carton.

The leading end of the tape commonly is intended to stay on to the surface of the front application roller using static charges generated by previous movement and friction on the non-adhesive surface of the tape. This is not reliable especially when taping the bottom of a case or carton, the tape often falls off the application roller and misses the carton.

Many mechanical devises are being used to retain the leading portion of the tape to prevent the falling of the tape as well as forming the tape from both side or in the middle of the tape in order to make the tape more rigid and thereby hold its position relative to the surface of the application roller, those devises are complicated which makes tape threading difficult, most importantly, they are not effective when a short tab length application is required i.e. a short tab has a leading end of the tape that is not long enough to reach the surface of the application roller. The short leading end of the tape is captured inside the retaining guides or a U sharp bracket, preventing the tape to contact the carton (see for example U.S. Pat. Nos. 4,642,157 and/or 7,836,932).

U.S. Pat. No. 5,725,721 provides an example of a device that can hold and expose the short leading end of the tape however, it does not provide a full surface support at the back of the tape to sufficiently presses the tape onto the carton surface and the tape will just smear the surface of the carton without adhesion so that the entire taping process is in effective.

In most cases, lacking full backing support of the short leading end of the tape causes the tape partially adhered onto the vertical surface of the carton, the corner of the carton may help to pull and advance the tape from up-stream to complete the taping process however, the taped carton is defective with insufficient adhesion of the front tab having the flaps loosely taped around the shoulder of the carton.

In carton taping, the tape is applied to the top (or bottom) and along the leading a trailing ends of the carton to form a U shape, commonly call C clip. The two ends (tabs) of the tape each extend from their adjacent corner of the carton and extend along the front and back vertical surfaces of the case respectively. Longer tabs are used for larger and heavier cases, shorter tabs are adjusted for shallower or smaller and lighter cases. The vertical tab length of the trailing end of the carton can be set commonly by an adjustable bar attached at the tip of the cutting cam, extend the bar to delay the cutting for longer tab length, retract the bar to release the cam sooner to shorten the tab length.

The front tab length adjustment is commonly achieved by adjusting the tension on the one way clutch roller with less tension for longer tab length and more tension for shorter tab length. This method is not very effective as the changes in tape tension can create problems in tape adhesion and tape cutting. Other tape applicator adjusts the mounting position of the one way clutch roller on the frame which controls the amount a tape length to pull back after the tape cutting when the front arm swings back from the retracted cutting position to the normal extended position. The more tape pulled back, shorter tape is exposed on the front application roller to tape the incoming vertical surface of the leading or front panel of oncoming carton;

The less tape pulled back, longer tape tab left to be applied on the front panel. Moving the one way clutch roller complicates the mounting of this roller and generally increases the time required to change between short and long front panel tabs. Most importantly, adjusting the one way clutch roller can only affect a small amount of tape length adjustment.

Control of the tape supply roll is commonly done using a spring leaf mounted stationary on the surface of the hub to hold the inside core of a tape roll. The leaf spring allows flexibility to accommodate a certain variation of core with standard diameter of 3". Most commonly the tape roll has to be forced in to the hub to secure the tape roll. Some hub comes with an eccentric roller with knurled surface and a small lever to tighten the tape roll. All these locking devise are not sufficient to secure the tape roll. The paper core inside diameter of a large roll usually smaller with tape wound. As the tape roll reduces towards the end, less tape wound around the paper core which starts to loosened and deformed, consequently the leaf spring or knurled surface roller lose their gripping effect and the tape roll slides off the hub.

BRIEF DESCRIPTION OF THE PRESENT INVENTION

It is an object of the present invention to provide solutions and improvements generally associated with carton taping in tape closure quality, tape applicator safety, reliability and performance and/or to improve surface contact to adhere to the carton particularly in soft, under-packed or un-even surfaces carton conditions.

It is a further object to provide a system using a single or multiple flexible wiping elements to provide, independent of the front roll and tape tension, pressure onto the tape to improve the adhesion of the tape onto the surface of the carton immediately after the start of tape application to reduce or eliminate the length of loosely adhered tape on the carton and by applying more concentrated force with less surface contact compared to commonly used rollers or brushes which have a much larger contact surface with the same amount of pressure being applied.

It is yet another object of the invention to reduce tape cutting knife safety risk and adhesive and debris build-up by combining cutting and tearing actions and to improve tape holding and guiding to facilitate long or short tape tab application.

It is a further object to provide a simple solution for over-spinning of a large tape roll (more tension needed) and reduced tension on a small tape roll and to provide an improved system for locking the tape roll to the mounting hub.

Broadly the present invention relates to a tape applicator for applying a tape to a case moved relative to said applicator in a forward direction, said applicator comprising a base, a source of tape to be applied by said tape applicator, said tape having an adhesive side and a non-adhesive side, a front applicator and a rear applicator, a front arm mounting said front applicator adjacent to a free end of said front arm and a rear arm mounting said rear applicator adjacent to a free end of said rear arm, a first pivotal mounting mounting said front arm and a second pivotal mounting mounting said rear arm, said first and second pivotal mountings mounting said front and rear arms on said base for rotation about parallel spaced axes, a push bar interconnecting said front and rear arms for acting together and means biasing said front and rear arms to a receiving position with said front applicator positioned to engage a case to which tape is to be applied by said tape applicator, a wiper means composed of at least one wiper element and each said wiper element is in the form of a strip having a fixed end and a free end remote from said fixed end, said wiper element has a thickness of between 0.10 and 0.75 inches and is positioned so that said free end extends across and engages with said tape and presses said tape against said case with a pressure of at least 1 pound per linear inch along said free edge contacting said tape as said tape is being applied to a case by said tape applicator when said case is moved in said forward direction, said strip being formed from a resilient, semi-rigid, shape retaining material so that said free end is deformed by pressure applied to said tape by said element as it wipes said tape into intimate contact with said case, a cut off means positioned adjacent to said front applicator for cutting said tape adjacent to said front applicator when said tape has been applied to said case, said cut off means including a cutter and a cut off cam, said cut-off cam being positioned to engage said case as it is being taped and functioning to control operation of said cut-off means to cut said tape, said wiper means being mounted on said base and positioned immediately in front of said cut off cam in said forward direction.

Preferably, the wiper is mounted in fixed relationship to said base.

Preferably the tape applicator includes a wiper arm on which said wiper means is mounted and a third pivotal mounting mounting said wiper arm on said base for movement about an axis parallel to said spaced parallel axes, said third pivotal mounting being positioned ahead of said cut-off cam in said forward direction and means biasing said wiper means against said case.

Preferably the applicator includes a rear wiper composed of at least one of said wiper elements fixed relative to said base in a position spaced from said front wiper in said forward direction.

Preferably the tape applicator includes a cutter and a cutter cam mounted on a cutter arm and positioned adjacent to a free end of said cutter arm, a pivotal cutter mounting at a mounting end of said cutter arm remote from said free end, said pivotal cutter mounting mounting said cutter arm on said base for pivotal movement about a pivotal cutter axis parallel to said spaced parallel axes and wherein said pivotal cutter axis is positioned on said base between said first and second pivotal axes ahead of said cutter cam in said forward direction Preferably the tape applicator cutter includes a cutter knife at one end of a shaping pad member, said cutter knife extending across said tape from one side edge of said tape for a distance of less than one third (⅓) the width of said tape, said cutter knife is mounted on said cutter arm and said pivotal cutter axis is positioned so that said cutter knife engages a path of said tape extending from said front applicator to said case at an angle β of between 25 and 75 degrees whereby severing of said tape by said cutting means is by initiating a cut at one side edge of said tape and tearing the tape the remainder of the width of said tape by interaction of said pad with said tape.

Preferably the tape applicator includes a shaping pad mounted on said front arm adjacent to said front applicator and between said front applicator and said source of tape and in position to contact said non-adhesive side of said tape, a deforming element mounted on said front arm and positioned to engage said adhesive side of said tape and deform side edges of said tape against said shaping pad so that the cross section of said tape is not flat and thereby the tape is given more rigidity, said shaping pad extending from said deforming element toward said front applicator and having a free end positioned adjacent to said front applicator so that said shaping pad has a free span extending from said deforming element to provide an exposed face of said adhesive side of said tape in position to contact said case, an exit roller mounted on said front arm and over which said tape passes on its way to said front applicator from said tape supply and a pressure surface on said shaping pad adjacent a pressure end of said shaping pad remote from said free end of said shaping pad positioned to hold said tape against said exit roller.

Preferably, the source of tape to be applied by said tape applicator includes a hub on which a roll of said tape is positioned, a tape support arm mounting said hub, a pressure applying member mounted on said arm in a position to engage and apply pressure to a side edge of said roll along a radial length of said roll of said tape extending from the maximum diameter of a full roll of said tape toward said hub and terminating at less than ⅓ the radial distance of said roll measured from said maximum diameter to said hub and wherein said pressure applying member is tapered to apply less unit pressure for each radial length of contact of said pressure applying member and said side edge of said roll as the maximum diameter of the depleting roll is reduced.

Preferably a tape roll locking system is mounted in said hub, said locking system including a rotatable shaft extending axially of said hub adjacent to an outer periphery of said hub and thus adjacent to a core of a roll of tape mounted on said hub, at least one locking element extending outward from said shaft and rotatable with said shaft between a locking position wherein said locking element pierces to lock said core and thereby said roll relative to said hub and a release position wherein said locking element is disengaged from said core, said locking element being resiliently bendable to permit limited axial movement of said core relative to said hub from and back to normal position when said element is said locking position.

BRIEF DESCRIPTION OF THE SEVERAL VIEWS OF THE DRAWINGS

Further features, objects and advantages will be evident from the following detailed description of the preferred embodiments of the present invention taken in conjunction with the accompanying drawings in which.

DETAILED DESCRIPTION OF THE INVENTION

Figure 1:
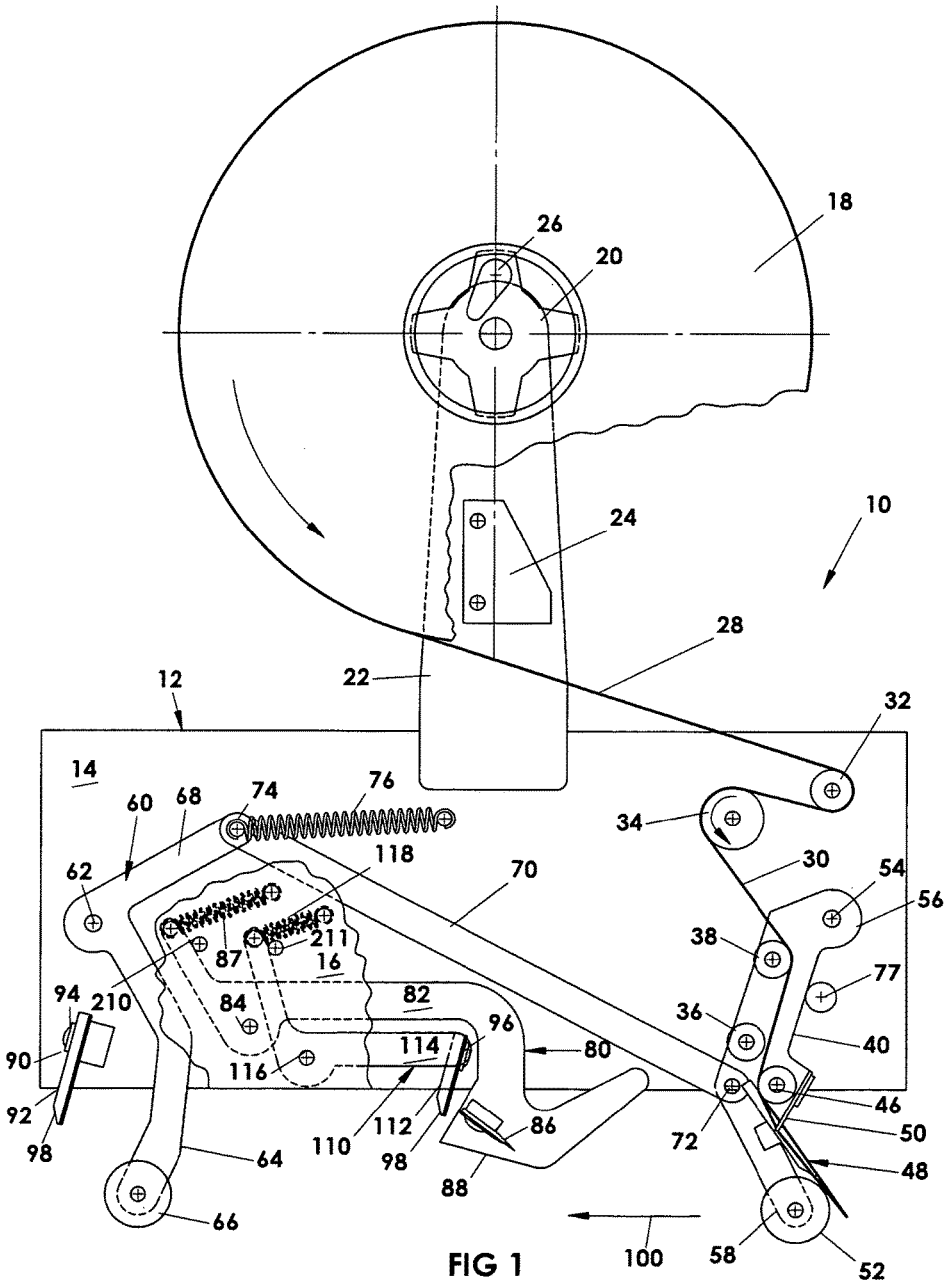
FIG. 1 shows the general view generally illustrating one embodiment of the present invention with parts omitted for clarity.

FIG. 1 shows the general view of a tape applicator 10 of the current invention having a base 12 formed by a pair of opposed substantially parallel walls 14 and 16 from which the various components of the applicator 10 are mounted. A tape roll 18 forming the supply of tape to be fed to the machine is mounted on a hub 20 which in turn is mounted on an arm 22 fixed to the wall 14. A braking system 24, which will be described in more detail with reference to FIGS. 7, 7*a*, 7*b*, 7*c* and 7*d*, is mounted on the tape support arm 22 and the hub 20 is provided with a locking system 26 which will be described in more detail with reference to FIGS. 8, 8*a*, and 8*b*.

The tape 28 follows along a tape path 30 by first passing over the guide roll 32 then the one-way clutch roller 34 mounted on the frame 14 and then over a selected one of the guide rolls 36 or 38 in the illustrated arrangement of FIG. 1 to selectively provide a long 42 (see FIG. 5*a*) or short 44 (see FIG. 5*c*) leading tab as will be described in more detail with reference to FIGS. 5, 5*a*, 5*b*, 5*c* and 5*d*.

From the roller 36 or 38 the path extends over the exit roller 46 over a shaping pad 48 against which the tape 28 is deformed by a deforming member 50 as will be described in more detail with reference to FIGS. 6, 6*a*, 6*b*, 6*c* and 6*d* and then to the front applicator shown as an applicator roll 52 (other forms of applicator may be used as is known in the art) to be applied to the leading face of a box or case or carton to be tape (not shown in FIG. 1) as will be described below. It will be noted and described below when a short leading tab is used the shaping pad 48 may be used to apply the tape to the leading face of the box or carton or case to be taped.

As will be apparent the rolls 36, 38, 46 and 52 are all mounted on the front applicator arm 40 as is the pad 48 and deformer or shaper 50. The front applicator arm 40 is mounted to the base 12 (plate or wall 16) on a first pivotal mounting 54 adjacent to the end 56 of the arm 40 remote from its free end 58 where the roll 52 is mounted.

As illustrate the applicator 10 also includes the conventional rear applicator arm 60 pivotally mounted to the base 12 on a second pivotal mounting 62. The rear arm 60 so call because it applies tape to the trailing end of the case being taped even though it is ahead of the front applicator arm 40 in the direction of travel 100 of the case being taped past or through the applicator 10. The arm 60 has an application arm or branch 64 mounting a rear applicator shown in the form of a roll 66 and a connecting arm or branch 68 on the opposite side of pivotal mounting 62 relative to the application arm 64. A pusher bar 70 is pivotally connected at one end to the arm 40 as indicated at 72 adjacent to the exit roller 46 and between the first pivotal mounting 54 and the applicator 52 and at its opposite end as indicated at 74 to the arm or branch 68 of the rear applicator arm 60 adjacent to the end of arm 68 remote from the second pivotal mounting 62 to thereby interconnect the arms 40 and 60 for action together. A spring 76 extending between the free end of the arm 68 and the base 12 biases the arms 40 and 60 to a receiving position against the stop as shown in FIG. 1 with the applicator 52 in position to engage the next case 102 being fed thereto.

Also shown in FIG. 1 is a cut-off of system as indicated at 80 that includes a cut off arm 82 pivotally mounted to the plate 16 of the base 12 via a pivotal cutter mounting 84 about which said cut-off arm 82 may rotate about an axis substantially parallel to the first 54 and second 62 pivotal axes. The arm 82 mounts a cutter 86 and is provided with a cut-off cam 88 to operate the cut-off system. The structure and operation of the cut-off system 80 will be described below with reference to 4, 4*a* and 4*c*.

A rear wiper 90 (leading in the direction of travel 100 of a case being taped) is fixed to the leading end of the base 12 (in the direction 100) in position to engage and wipe the tape onto the case as it is moved there past. More important a front wiper 110 which includes at least one wiper element 112 mounted on a wiper arm 114 pivotally mounted to the base 12 (base plate 16) via a third pivotal mounting 116 for rotation on an axis substantially parallel to the axes of the first 54 and second 62 pivotal mountings. The wiper element 112 is biased by a spring 118 extending between an end of the wiper arm 114 remote from the wiper element 112 and on the opposite side of pivotal mounting 116 and the base 12 applies the desired wiping force to the element 112.

The rear wiper 90 is composed of at least one wiper element 92 and the front wiper has been shown with one wiper element 112 but it will be apparent that the wipers 90 and/or 110 may employ more than one element 92 or 112 arranged in substantially parallel spaced relationship. The construction of the wiper elements (or pads) 92 and/or 112 will be described below.

Figure 2:
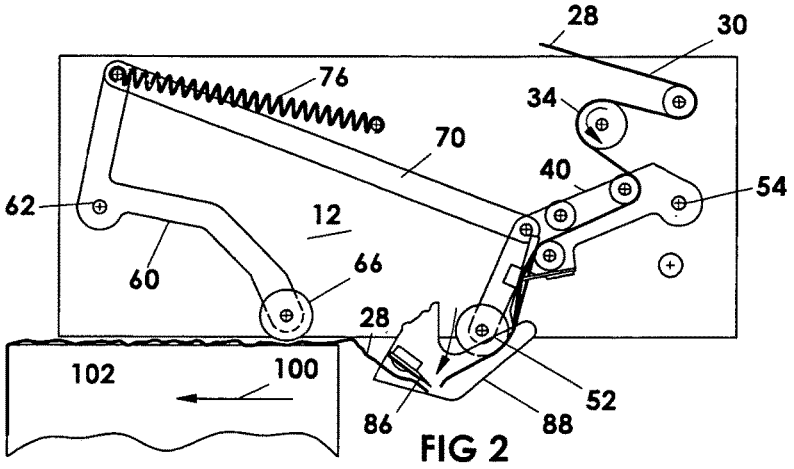
FIG. 2 shows the tape applicator of the present invention applies and cuts the tape similar to a conventional tape applicator showing a problem that occurs with soft under-filled carton with insufficient tape adhesion onto the carton.

FIG. 2 (wherein like numbers have been used to indicate like parts from FIG. 1) illustrates schematically a tape applicator wherein no additional wiper means is provided other than the applicator rolls 52 and 66 on the front and rear arm 40 and 60. As illustrated it is not uncommon to have a problem obtaining intimate bonding of the tape 28 to the carton 102.

Figure 2A:
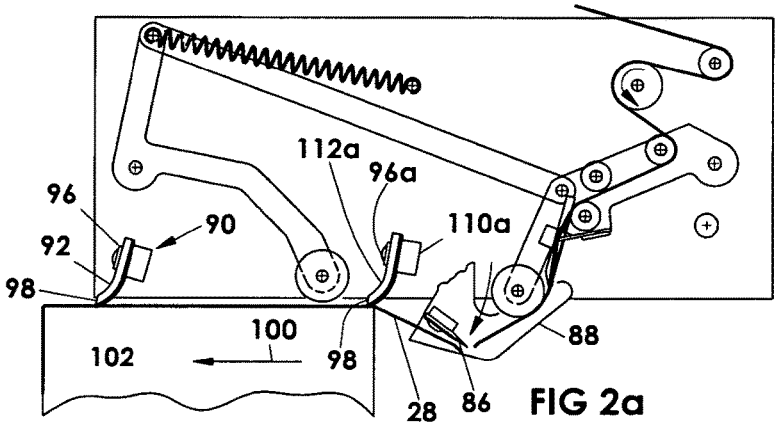
FIG. 2*a* shows the present invention with parts omitted for clarity employing two flexible wiping pads with one mounted onto the base frame to contact the tape being applied immediately in front of the cut-off mechanism in the forward direction of movement of the case or carton through the tape applicator and a second flexible wiping pad mounted on the base frame adjacent to the discharge end of the tape applicator.

In FIG. 2*a* a rear 90 and a front applicator 110*a* both fixed to the base 12 (110*a* is fixed as opposed to the applicator 110 shown in FIG. 1) each of which is composed of at least on wiper element 92 or 112. Positioning of the wiper 110*a* (or 110 depending which is used) immediately in front of (leading) the cut-off device in the direction 100 i.e. close to the cutter 200 if used with the prior art cutter or the cutter 86 and cam 88 of the present invention is very important in determining the effectiveness of the applicator 10 in adhering the tape to the carton 102, pressing the tape tight around the flaps and preventing "tape flagging" (wrinkling) and pressing the corner of the case or carton to facilitate the rear applicator roll 66 to apply the trail end of the tape onto the surface of the trailing end of the case or carton.

The physical characteristic of element(s) (or pad(s)) 92 or 112 of the wiper 90, 110*a* or 110 are also very important to obtaining proper adherence of the tape to the carton. Each of these wiper elements 90, 112 is in the form of a strip having a fixed end 94 or 96 or 96*a* and a free end 98 remote from its fixed end. The thickness said wiper element or strip is between 0.10 and 0.75 inches and the free end 98 extends across and engages with said tape 28 across the full width of the tape and has a resilience so that the element 92, 112 or 112*a* presses the tape 28 against said case 102 with a pressure of at least 1 pound per linear inch along the free edge 98 contacting said tape 28. The strip or element is thus formed from a resilient, semi-rigid, shape retaining material so that said free end 98 is deformed by pressure applied to said tape by the element(s) as it wipes tape into intimate contact with said case.

Figure 2E:
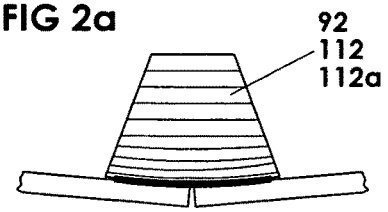
FIG. 2*e* shows the front view of the flexible wiping pad pressing the tape onto the center of the two flaps of an under-filled, soft carton.
Figure 2B:
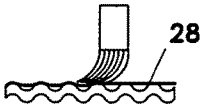
FIG 2b PRIOR ART
FIG. 2*b* illustrates a piece of tape being brush onto a corrugated surface by a commonly used brush with minimum tape adhesion on the corrugated surface.
Figure 2C:
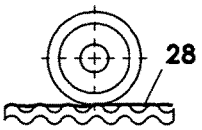
FIG 2c PRIOR ART
FIG. 2*c* illustrates a piece of tape being roll onto the same corrugated surface by a commonly used roller with rubber coating with minimum adhesion on the corrugated surface.
Figure 2D:
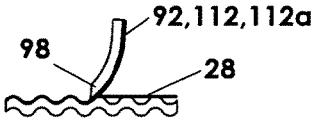
FIG. 2*d* illustrates a piece of tape being scraped on the corrugated surface by the flexible wiping pad of the current invention.

A brush or roll is sometimes installed at the discharge end of the tape applicator to brush down the front portion of the tape before the cutting takes and then brush down the uneven loose tape thereafter. These actions are illustrated in FIGS. 2*b* and 2*c* respectively which show the tape bridging the corrugations of the underlying corrugated board whereas the wiper elements 92, 112 and 112*a* described above are capable of obtaining as illustrated in FIG. 2*d* more intimate contact and better conform the tape to the underlying corrugated material to which it is applied. The thin contact edge 98 of the wiper element 92, 112 or 112*a* reduces the area of contact, concentrating the applied pressure as well as enabling the tape to penetrating more uneven surfaces of the corrugated surface.

The flexible wiping element 92 112 or 112*a* is designed to accommodate various surface profiles (see FIG. 2*e*), unevenness, soft under-filled and empty cartons, over-filled bulky cartons, including cartons made with recycle materials etc. The wiping action of the elements 98 provides a better adhesive transfer and coverage from the tape onto the substrates, and tends to eliminate air pockets, wrinkles, etc.

The preferred arrangement of the invention is the system shown in FIG. 1 and described above. The spring loaded arm with wiping pad shown on FIG. 1 can be used to obtain more movement for uneven surfaces and various distances between the tape head and the carton.

Figure 3:
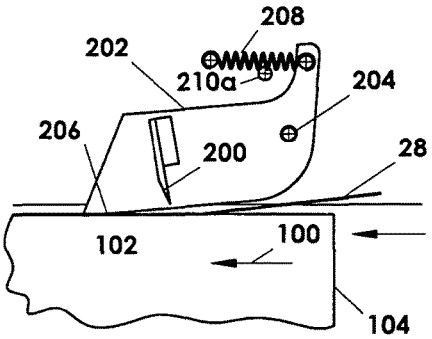
FIG 3 (PRIOR ART)
FIG. 3,3*a*, illustrate the action of a cutting cam and cutting knife of a conventional tape applicator for automatic case taping.
Figure 3A:
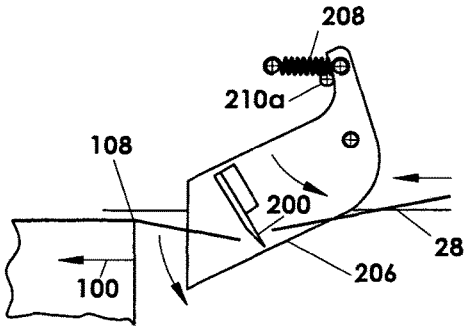
FIG 3a (PRIOR ART)

FIGS. 3 and 3*a* have been provided to show the prior art cutting action so the difference between the prior art and the present invention will be more apparent. In the prior art the practice has been to provide a knife 200 mounted on a cam 202 which is pivotally mounted on the base 12 on a pivot of axel 204 that is behind the knife 200 in the direction 100 of movement of the case 102 so that when the knife cam surface 206 clears the trailing edge 108 of the case 102 the cutting action of the cutting blade obtained by the action of the spring 208 is about 90 degrees to the tape 28 (or tape path 30) see FIG. 3*a*.

Figure 4:
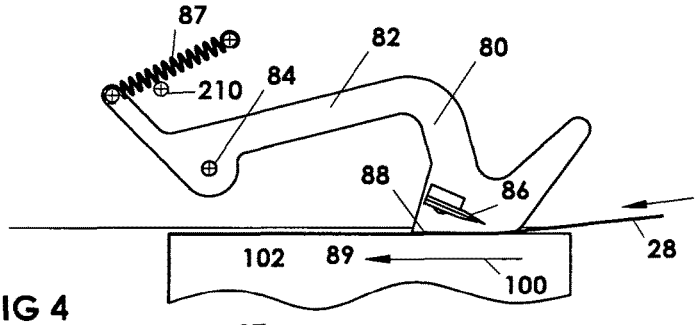
FIGS. 4 and 4*a* shows the cutting cam of the present invention with the pivoting point for the cutter down-stream of i.e. in front of or leading the cutting blade in the direction of movement of a carton through the tape applicator.
Figure 4A:
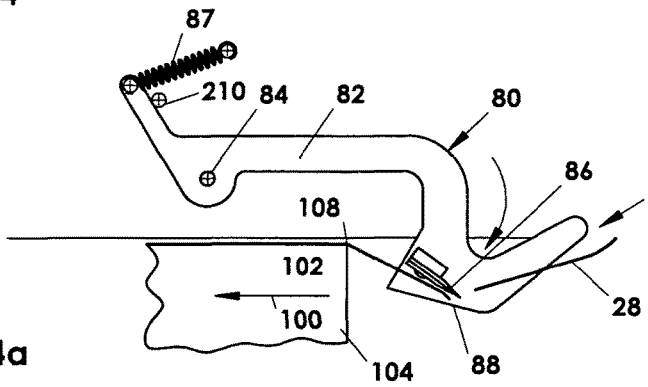

The present invention as partly described above mounts the cut-off knife 86 on an arm 82 that is pivotally mounted on the base 12 via a cutter pivotal mounting 84 that is positioned ahead or down-stream of the cutting blade or knife 86 and cutter cam 88 in the direction of travel 100 and permits pivotal movement on an axis substantially parallel to the first and second pivotal axes 54 and 62. The arm 82 is biased by a spring 87 connecting the end of the arm 82 remote from the cutter 86 to press the cam 88 toward the adjacent surface 89 of the case 102 and beyond when not supported by the surface (see FIGS. 4 and 4*a*). The pane of the knife 86 is substantially radial to the pivotal mounting 84 and is oriented at an angle β of between about 25 and 75 degrees to the path 30 of the tape 28 where it traverses the trajectory of the knife 86 (see FIG. 4*c*) in the cutting operation. This action of the cutting blade 86 across the path 30 and the use of a cutter as illustrated in FIG. 4*b* significantly improves the cutting of the tape and enables a light spring (light tape tensioned) to be used since the partially cut tape drags the knife and pulls the cutting mechanism 80 against the stop 210 and consequently tears across the remaining width of the tape 28.

Figure 4B:
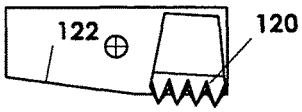
FIG. 4*b* shows the sectional serrated knife and tearing guide of the present invention.
Figure 4C:
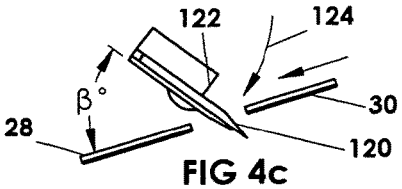
FIG. 4*c* shows the cutting action of the present invention with a sectional serrated blade and the tearing guide plate.

The improved cutter as shown in FIG. 4*b* employs as seriated cutting edge 120 at one side edge of the cutter positioned to cut one side edge of the tape 28 and an elongated cutter anvil 122 that engages and tears the tape across the remainder of its width to the side of the tape opposite the one side. The seriated cutter 120 extends less than ⅓ the width of the tape 28 from one side of the tape 28 and the movement of the anvil 122 across the tape as indicated by the arrow 124 tears the tape 28 from the knife 120 across the remaining width of the tape 28.

With the pivot point in front of or down-stream of the cutting blade as above described, the cutting motion of the knife 86 towards the tape is in the direction of the movement of the tape 28 along the tape path 30 and is oriented to intersect the tape path 30 with the inclusive angle from 25 to 75 degrees. The serrated blade 120 "catches" or "stalls" the tape and pulls the cutter 80 against the stop 210 to tear the tape 28 and complete the severing of the tape.

Figure 5:
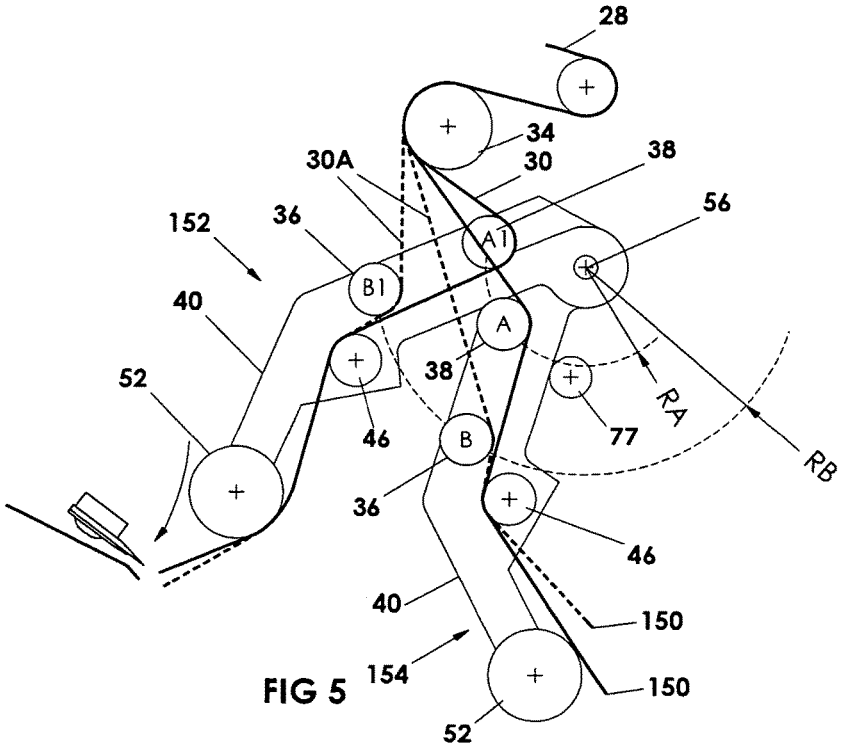
FIG. 5 shows the applicator with parts omitted for clarity illustrating the system for obtaining different leading or front tape tab lengths.
Figures 5A, 5B:
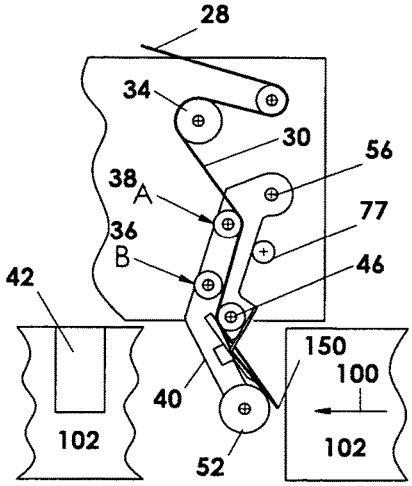
FIG. 5*a* shows a long front tab length on a carton.
FIG. 5*b* shows the tape is threaded on guide roller close to the pivot mounting of the front application arm to define a smaller arc of travel and thereby less tape pulled back and allowing more tape stay on the front roller.
Figures 5C, 5D:
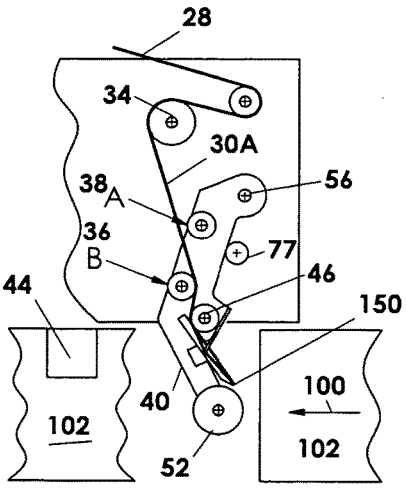
FIG. 5*c* shows a short front tab length on a carton.
FIG. 5*d* shows the tape is threaded on guide roller further away from the pivot of the front application arm compared to FIG. 5*b* which provides a lager arc of travel and thereby more tape is pulled back and allowing less tape stay on the front roller to [produce a shorter tab on the next taped carton.

Turning to FIGS. 5 to 5*d* inclusive the system for obtaining different length leading end tabs of tape 28 as illustrated at 42 (short tab) and 44 (long tab) in FIGS. 5*a* and 5*c* is illustrated.

As discussed above when it is desired to change the length of tab from a short tab 42 to the longer tab 44 (and vice versa) the prior art used a system of moving the one way clutch roll 34, or adjusting the tension of the clutch roller which have limited and negative effects. The present invention overcomes this problem by providing a two guide rolls A (38) and B (36) mounted on the front applicator arm 40 in radially spaced relationship relative to the first pivotal mounting 56.

As illustrated in FIG. 5 showing the arm 40 in two different positions and two different paths rot the tape 28 with one path 30 shown in a solid line and the alternative path 30A shown as a dash line. The solid line path 30 extends from the one way clutch roll 34 to the roll A (38) mounted on the arm 40 at a short radius RA from the pivot mounting 56 and from the roll A (38) the tape passes to the roll 46. The dash line path 30A on the other hand extends from the one way clutch roll 34 to the roll B (36) mounted on the arm 40 at a long radius RB (longer than the radius RA) from the pivot mounting 56 and from the roll B the tape passes to the roll 46. It is apparent that the change in length of the dash line path 30A between the one way clutch roll 34 and the free end 150 of the tape 28 is shorter than the equivalent length along solid line path 30 so that when the arm 40 is moved from the upper position (cutting position) shown in FIG. 5 to the lower position (ready or initial position to receive the next case) the free end 150 of the tape extends farther from the roll 46 in the solid line position 30 than in the dash line position 30A so the length of material available to form the tab 42 or 44 is adjusted. It is apparent that one could mount a roll say roll A (38) to be movable along the arm 40 to obtain a number of different tape paths by changing the radius RA.

Figure 6:
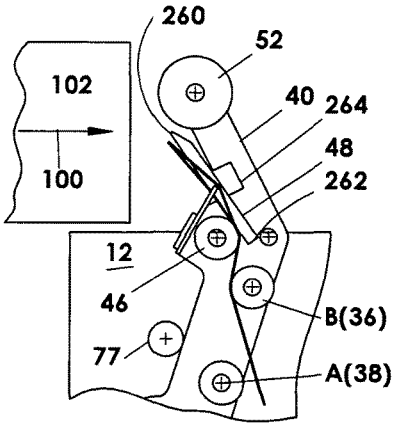
FIG. 6 shows the tape applicator with the front applicator arm equipped with the front applicator in the form of a roller mounted in inverted position with short tab for bottom taping and incorporating the tape holding and guiding apparatus of the present invention.
Figure 6A:
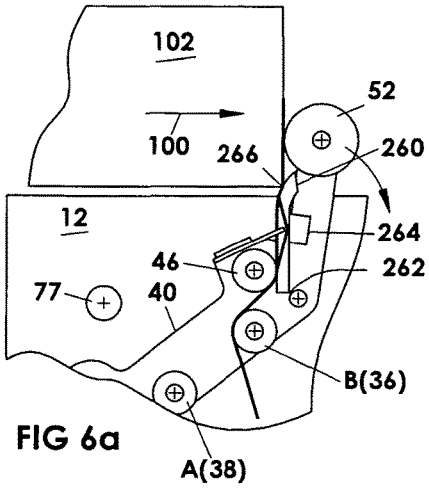
FIG. 6*a* shows the engagement of the front short tab application with the tape applied initially by the flexible backing pad of the present invention and deflecting of the flexible backing pad at the corner of the carton to tightly wrap the tape around the corner of the carton.
Figure 6B:
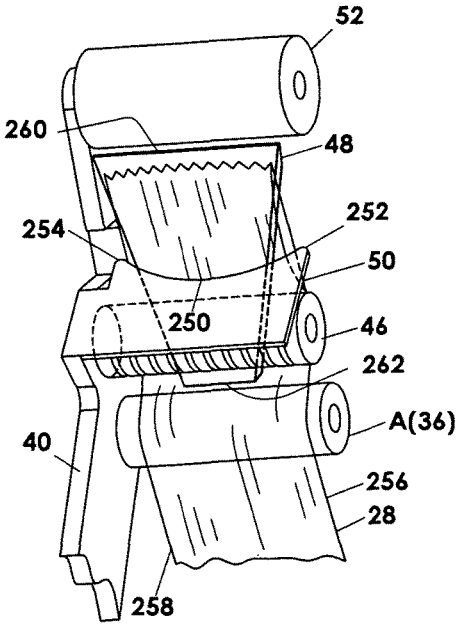
FIG. 6*b* shows the isometric view of the front apply arm as shown in FIG. 6*a*.
Figure 6C:
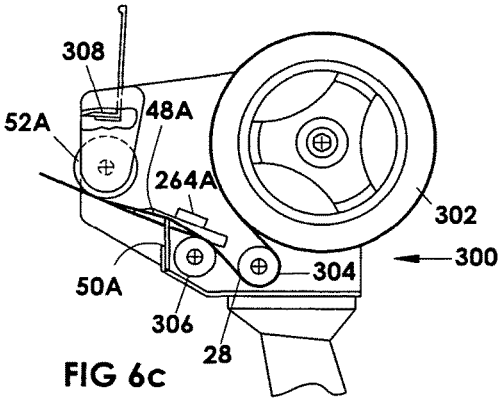
FIG. 6*c* shows the section of tape being formed into a structural shape with both sides of the tape as applied to a hand machine for manually applying a tape.
Figure 6D:
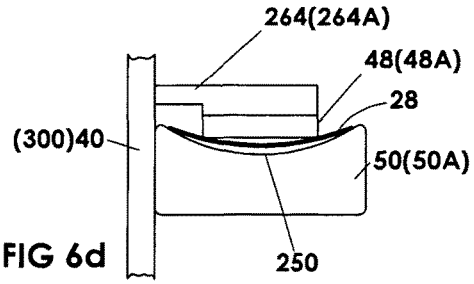
FIG. 6*d* shows a cross section top view of the tape with the curved external tape guide deflecting the sides of the tape against the tapered flexible backing pad, forming the tape into a curved structural shape across its width.

As shown in FIGS. 5*b* and 5*d* when the longer tape tab 42 is to be produced using the solid line path 30 of FIG. 5 the free end 150 of the tape 28 is located at about the centre of or slightly beyond the application roll 52 (See FIG. 5*b*) when the shorter tab 44 is to be applied the tape follows the path 30A of FIG. 5 and the free end 150 of the tape 28 is positioned before the roll 52 i.e. over the shaping pad 48 which functions to shape the tape 28 and applies light pressure against the knurled exit roller 46 to prevent over-spinning as the tape retreats relative to the roll 52 as the arm 40 moves to its home or receiving position against the stop 77 as will be more fully described with reference to FIGS. 6 to 6*d*.

The tape 28 as it is fed toward the applicator roll 52 passes along a trapezoidal shaped shaping pad member 48 about which it is deformed by the shaper 50 which has a curved concave edge surface 250 facing toward the shaping pad 48 and with a pair of in effect horns 252 and 254 one on each side to the pad 48 that engage the adhesive side of the tape 28 and deform the tape adjacent to each of its side edges 256 and 258 to thereby form the tape 28 into a curved cross section making the tape more rigid so that it will remain adjacent to the pad 48. The pad 48 has a leading end 260 (in the direction of tape movement) that is preferably at least as wide as the full width of the tape 28 and is positioned adjacent to the applicator roll 52 and a trailing end 262 positioned on the up-stream side of the knurled surface exit roll 46. The horns 252 and 254 are preferably located about midway between the ends 260 and 262 and the curve surface 250 only engages the adhesive surface if the tape over very short widths adjacent each side edge of the tape 28. The shaping pad 48 is mounted on the arm 40 on a bar 264 positioned about midway between the ends 260 and 262. Both ends of the pad 48 are flexible so that the wider end 160 may be deform when wiping the tape 28 securely against the corner of the box 102 being taped and shown at 266. The trailing portion of the pad 48 between the mounting bar 264 and the small end is flexible to apply pressure through the tape 28 against the roll 46 as above disclosed and to permit the pad 48 to be moved away from the roll 46 for threading of the tape onto the machine.

FIG. 6*c* show a hand operated device 300 that incorporates the shaping pad 48 and shaper 50 described above and having essentially the same characteristics but designated as 48A and 50A respectively. The pad 48A and shaper 50A are each constructed in essentially the same way and perform in essentially the same way as their equivalents 48 and 50 as described above and the mounting bar 264 and 264A. The tape 28 from the roll 302 passes from tape roll 302 over guide roll 304 and exit roll 306 (equivalent to the roll 46 is deformed over the shaping pad 48A by the shaper 50A and then is guided and supported by the pad 48A to the applicator roll 52*a* equivalent to the roll 52 described above. A suitable cut-off knife 308 is position beyond the roll 52A to cut the tape 28 after it has been applied.

Figure 7:
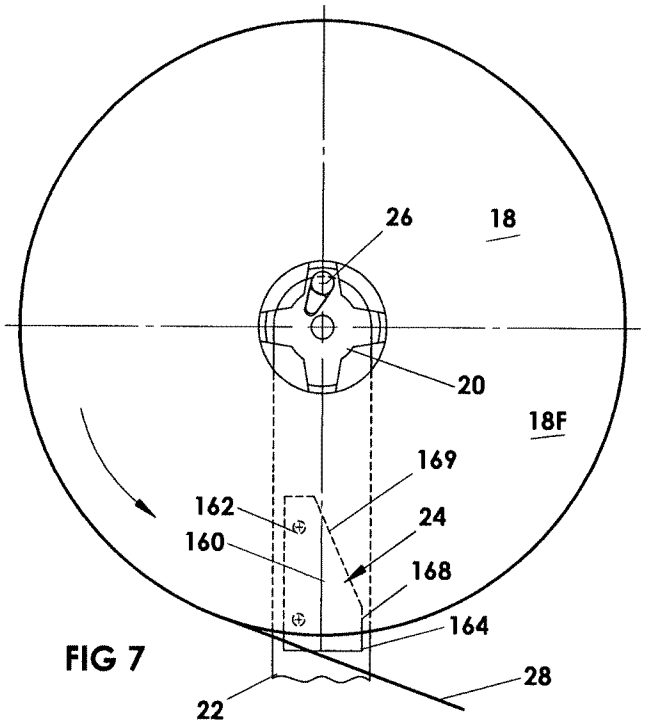
FIG. 7 shows the front view of a large tape roll installed on the hub mounted on a tape holding bar.
Figure 7A:
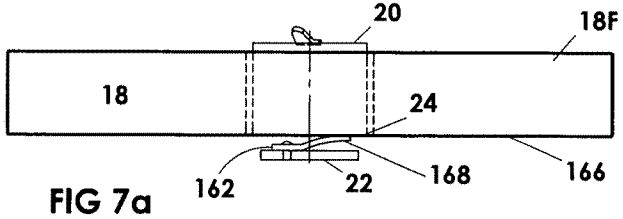
FIG. 7*a* shows the bottom view of FIG. 7, showing a flexible friction pad pressed against the side of the tape roll.
Figure 7B:
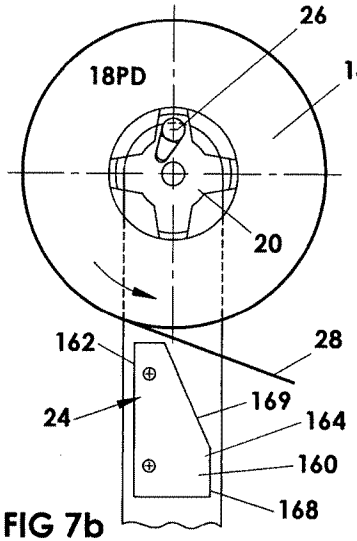
FIG. 7*b* shows the front view of tape roll reduced into a smaller roll, with the flexible friction pad completely away from the tape roll.
Figure 7C:
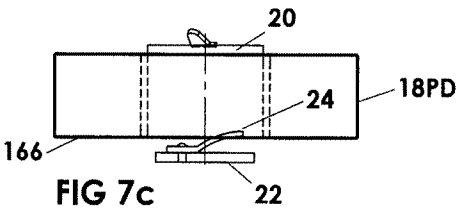
FIG. 7*c*, 7*d* show the bottom view and side view of FIG. 7*b* with the flexible friction pad is completely away from the small tape roll.
Figure 7D:
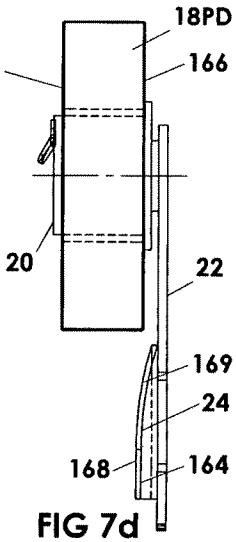

Turning to FIGS. 7 to 7*d*, the pressure applying member 24 that provides a brake for controlling the rotation of the tape roll 18 is more clearly shown. As shown the pressure applying member is in the form of a resilient braking wiper 160 having a trailing edge 162 trailing in the direction of movement of the adjacent side of the tape roll 18 as it is being unwound to feed tape to the applicator 10 fixed to the tape supporting arm 22 on which the hub 20 is mounted. The wiper 160 extends away from the arm 22 and terminates at a free edge 164 that is spaced from the arm 22 by a distance greater than the normal spacing of the adjacent side face 166 of the roll 18. The free edge 164 is provide into a outer portion 168 the extends about radial relative to the roll 18 at the radial outer portion of the wiper 160 and an inclined portion 169 that extends at any suitable angle in towards the fixed end 162 to reduce the pressure of the wiper 160 on the side 166 of the roll at a desired rate as the tape 28 is dispensed from the roll 18.

The side 166 of the full roll 18 indicated by the designation 18F in FIGS. 7 and 7*a* is engaged by the pressure member 160 that applies pressure to deter the rotation of the full roll however this pressure reduces as the periphery of the roll 18 reaches the inclined portion 169 and moves along it as the size of the roll is diminished. This gradual diminishing of the pressure applied by the pressure member 160 continues until the side 166 is sufficiently short (measured in the radial direction of that roll 18) that it no longer contacts the member 160 at which time the member 160 no longer influences the rotation of the roll 18 i.e. the partially depleted roll 18PD (see FIGS. 7*b, c* and *d*) is free to rotate with the hub 20.

The use of the brake 24 facilitates the use of large diameter tape rolls which obviously need to be replaced less frequently than smaller diameter rolls.

Figure 8:
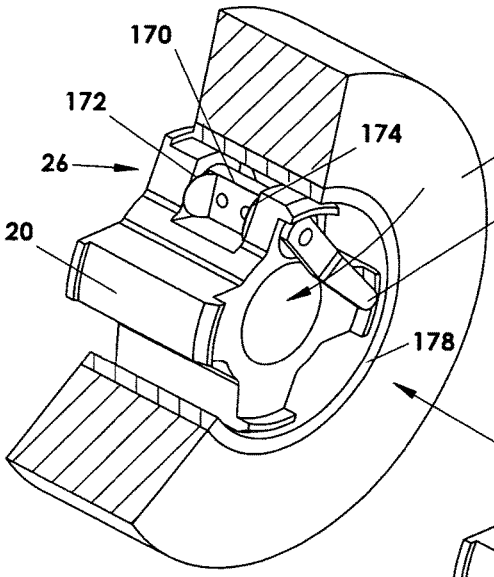
FIG. 8 shows a locking device of the present invention built in the tape roll hub and with the locking element(s) in disengaged position for inserting or removing the tape roll.
Figure 8A:
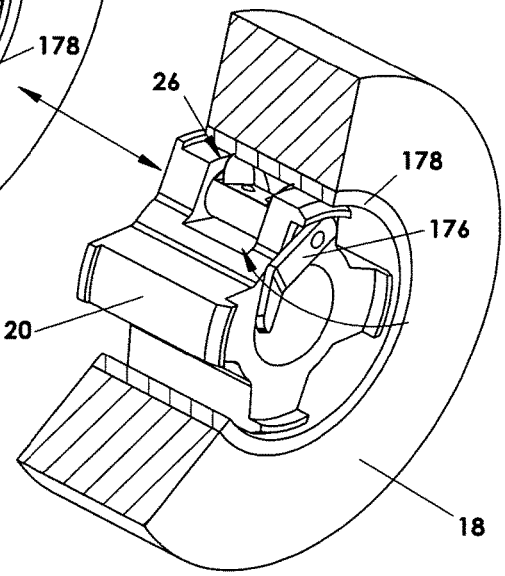
FIG. 8*a* shows the tape roll in locked into position.
Figure 8B:
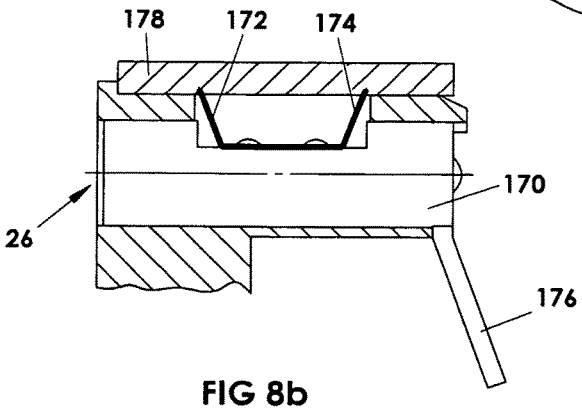
FIG. 8*b* shows the partial cross section view of the hub with locking devise, operating lever, and the engagement of the locking element(s) with the tape roll core.

Particularly when larger diameter tape rolls 18 are to be used it is important that they be securely fastened to the hub 20. The present invention provides a suitable locking device 26 which as shown in FIGS. 8, 8*a* and 8*b* is mounted in the hub 20. This device 26 is made up of a shaft 170 extending axially of the hub 20 and positioned adjacent to the outer periphery of the hub 20. The shaft 170 is provided with 2 core piercing disk like elements 172 and 174 (more or fewer such elements may be used and their shapes may be varied) that project outward from the shaft so that when the shaft 170 is rotated by manipulation of the control arm 176 from the unlocked position shown in FIG. 8 wherein the outer periphery of the elements 172 and 174 are within the outer periphery of the hub 20 to the locking position wherein the outer peripheries of the elements 172 and 174 extend beyond the periphery of the hub 20 and cut into the core 178 of the roll 18 i.e. penetrate into a locking position wherein the roll 18 is effectively locked to the hub 20 as shown in FIG. 8. The locking elements 172 and 174 are resiliently bendable to permit limited axial movement of said core 18 relative to said hub 20 from and back to normal position when the elements 172 and 174 are locking position with the ends of the elements 172 and 174 penetrating the core 178.

Having described the invention, modifications will be evident to those skilled in the art without departing from the scope of the invention as defined in the appended claims.

I claim:

1. A tape applicator for applying a tape to a case moved relative to said applicator in a forward direction, said applicator comprising a base, a source of tape to be applied by said tape applicator, said tape having a width, an adhesive side and a non-adhesive side, a front applicator and a rear applicator, a front arm mounting said front applicator adjacent to a free end of said front arm and a rear arm mounting said rear applicator adjacent to a free end of said rear arm, a first pivotal mounting mounting said front arm and a second pivotal mounting mounting said rear arm, said first and second pivotal mountings mounting said front and rear arms on said base for rotation about parallel spaced axes, a push bar interconnecting said front and rear arms for acting together and means biasing said front and rear arms to a receiving position with said front applicator positioned to engage a case to which tape is to be applied by said tape applicator, a wiper composed of at least one wiper element and each said wiper element is a continuous strip formed by a resilient, semi-rigid, shape retaining material that is deformable when applying pressure to said tape when said applicator is used to apply said tape to said case, said strip having a fixed end and a free end remote from said fixed end, said wiper element is positioned so that said free end extends continuously across effectively a full said width of said tape when said applicator is used to apply said tape to said case, a cut off means positioned adjacent to said front applicator for cutting said tape adjacent to said front applicator when said tape has been applied to said case, said cut off means including a cutter and a cut off cam, said cut-off cam being positioned to engage said case as it is being taped and functioning to control operation of said cut-off means to cut said tape.

2. A tape applicator for applying a tape to a case moved relative to said applicator as defined in claim 1 wherein said wiper is mounted in fixed relationship to said base.

3. A tape applicator for applying a tape to a case moved relative to said applicator as defined in claim 1 further comprising a wiper arm on which said wiper is mounted and a third pivotal mounting mounting said wiper arm on said base for movement about an axis parallel to said spaced parallel axes, said third pivotal mounting being positioned ahead of said cut-off cam in said forward direction and means biasing said wiper-against said case.

4. A tape applicator for applying a tape to a case moved relative to said applicator as defined in claim 3 wherein said wiper includes a front wiper and a rear wiper each composed of at least one of said wiper elements fixed relative to said base, said rear wiper being in a position spaced from said front wiper in said forward direction.

5. A tape applicator for applying a tape to a case moved relative to said applicator as defined in claim 1 wherein said wiper includes a front wiper and a rear wiper each composed of at least one of said wiper elements fixed relative to said base, said rear wiper being in a position spaced from said front wiper in said forward direction.

6. A tape applicator as defined in claim 1 wherein said cutter means includes a cutter and said cutter cam mounted on a cutter arm and positioned adjacent to a free end of said cutter arm, a pivotal cutter mounting at a mounting end of said cutter arm remote from said free end, said pivotal cutter mounting mounting said cutter arm on said base for pivotal movement about a pivotal cutter axis parallel to said spaced parallel axes and wherein said pivotal cutter axis is positioned on said base between said first and second pivotal axes ahead of said cutter cam in said forward direction.

7. A tape applicator as defined in claim 6 wherein said cutter includes a cutter knife at one end of a cutter anvil, said cutter knife extending across said tape from one side edge of said tape for a distance of less than one third (⅓) the width of said tape, said cutter knife being mounted on said cutter arm and said pivotal cutter axis being positioned so that said cutter knife engages a path of said tape extending from said front applicator to said case at an angle β of between 25 and 75 degrees whereby severing of said tape by said cutting means is by initiating a cut at one side edge of said tape and tearing the tape the remainder of the width of said tape by interaction of said pad with said tape.

8. A tape applicator for applying a tape to a case moved relative to said applicator in a forward direction as defined in claim 1 wherein a pair of tab adjusting guide rolls are mounted on said front applicator arm in radially spaced relationship relative to said first pivotal mounting, an exit roll mounted on said front arm, said pair of guide rolls being between said first pivotal mounting and said exit roll a first of said pair of tab adjusting rolls being mounted farther from said first pivotal mounting than a second of said pair of tab adjusting guide rolls whereby when a shorter front tab is desired said tape bypasses said first tab adjusting guide roll and warps said second of said pair of tab adjusting guide rolls and when a longer front tab is desired said tape wraps only said first tab adjusting guide roll.

9. A tape applicator for applying a tape to a case moved relative to said applicator in a forward direction as defined in claim 1 wherein, said wiper is mounted on said base and positioned immediately in front of said cut off cam in said forward direction.

10. A tape applicator for applying a tape to a case moved relative to said applicator as defined in claim 9 wherein said wiper is mounted in fixed relationship to said base.

11. A tape applicator for applying a tape to a case moved relative to said applicator as defined in claim 10 further comprising a rear wiper composed of at least one of said wiper elements fixed relative to said base in a position spaced from said front wiper in said forward direction.

12. A tape applicator for applying a tape to a case moved relative to said applicator as defined in claim 9 further comprising a wiper arm on which said wiper is mounted and a third pivotal mounting said wiper arm on said base for movement about an axis parallel to said spaced parallel axes, said third pivotal mounting being positioned ahead of said cut-off cam in said forward direction and means biasing said wiper against said case.

13. A tape applicator for applying a tape to a case moved relative to said applicator as defined in claim 9 further comprising a rear wiper composed of at least one of said wiper elements fixed relative to said base in a position spaced from said front wiper in said forward direction.

14. A tape applicator for applying a tape to a case moved relative to said applicator in a forward direction, said applicator comprising a base, a source of tape to be applied by said tape applicator, said tape having an adhesive side and a non-adhesive side, a front applicator and a rear applicator, a front arm mounting said front applicator adjacent to a free end of said front arm and a rear arm mounting said rear applicator adjacent to a free end of said rear arm, a first pivotal mounting mounting said front arm and a second pivotal mounting mounting said rear arm, said first and second pivotal mountings mounting said front and rear arms on said base for rotation about parallel spaced axes, a push bar interconnecting said front and rear arms for acting together and means biasing said front and rear arms to a receiving position with said front applicator positioned to engage a case to which tape is to be applied by said tape applicator, a cutter means that includes a cutter mounted on a cutter arm and a cutter cam positioned adjacent to a free end of said cutter arm, a pivotal cutter mounting at a mounting end of said cutter arm remote from said free end, said pivotal cutter mounting mounting said cutter arm on said base for pivotal movement about an axis parallel to said spaced parallel axes and wherein said pivotal cutter axis is positioned on said base ahead of said cutter cam in said forward direction and between said first and second pivotal axes and said cutter is adjacent to said front applicator.

15. A tape applicator for applying a tape to a case as defined in claim 14 wherein said cutter includes a cutter knife at one end of a cutter anvil, said cutter knife extending across said tape from one side edge of said tape for a distance of less than one third (⅓) the width of said tape, said cutter knife being mounted on said cutter arm and said pivotal cutter axis being positioned so that said cutter knife engages a path of said tape extending from said front applicator to said case at an angle β of between 25 and 75 degrees whereby severing of said tape by said cutting means is by initiating a cut at one side edge of said tape and tearing the tape the remainder of the width of said tape by interaction of said pad with said tape.

* * * * *